US006933917B2

(12) United States Patent
Chung et al.

(10) Patent No.: US 6,933,917 B2
(45) Date of Patent: Aug. 23, 2005

(54) METHOD AND CIRCUIT FOR LCD PANEL FLICKER REDUCTION

(75) Inventors: Te Cheng Chung, Tao-Yuan (TW); Seok Lyul Lee, Tao-yuan (TW); Tean Sen Jen, Tao-yuan (TW); Ming Tien Lin, Taipei (TW)

(73) Assignee: Hannstar Display Corporation (TW)

( * ) Notice: Subject to any disclaimer, the term of this patent is extended or adjusted under 35 U.S.C. 154(b) by 314 days.

(21) Appl. No.: 10/395,595

(22) Filed: Mar. 25, 2003

(65) Prior Publication Data

US 2003/0227431 A1 Dec. 11, 2003

(30) Foreign Application Priority Data

Jun. 7, 2002 (TW) ..... 91112397 A

(51) Int. Cl.[7] ..... G09G 3/36
(52) U.S. Cl. ..... 345/98; 345/100
(58) Field of Search ..... 345/87–104, 209, 345/211

(56) References Cited

U.S. PATENT DOCUMENTS 4,586,039 A * 4/1986 Nonomura et al. ..... 345/90
5,307,084 A * 4/1994 Yamaguchi et al. ..... 345/58
6,310,598 B1 * 10/2001 Koyama et al. ..... 345/98
6,567,062 B1 * 5/2003 Kudo et al. ..... 345/92
6,727,875 B1 * 4/2004 Mikami et al. ..... 345/92
2002/0008686 A1 * 1/2002 Kumada et al. ..... 345/94
2002/0047822 A1 * 4/2002 Senda et al. ..... 345/90

* cited by examiner

*Primary Examiner*—Xiao Wu
(74) *Attorney, Agent, or Firm*—Morris Manning & Martin; Tim Tingkang Xia, Esq.

(57) ABSTRACT

A method and circuit for LCD panel flicker reduction. The invention relates to an adjustment circuit to reduce an LCD panel flicker, wherein the LCD panel has a plurality of scan lines and a plurality of data lines. In one embodiment, the adjustment circuit includes a variable resistor, and a plurality of impedance adjustment devices, each with impedance and having a control terminal to be coupled with a DC voltage source through the variable resistor, a power terminal to be coupled with a common voltage source, and a scan line terminal to be coupled with a scan line, wherein the impedance of each of the impedance adjustment devices can be varied when the resistance of the variable resistor is varied. Each of the impedance adjustment devices in one embodiment has a transistor. The impedance of each of the impedance adjustment devices is much higher than the impedance of the corresponding scan line to allow the LCD to be operated at higher frequencies.

12 Claims, 4 Drawing Sheets

Data signal

Scan signal

| | 1 | 2 | 3 | 4 | 5 |
|---|---|---|---|---|---|
| 1 | + | + | + | + | + |
| 2 | + | + | + | + | + |
| 3 | + | + | + | + | + |
| 4 | + | + | + | + | + |
| 5 | + | + | + | + | + |

Frame Inversion

Data signal

Scan signal

| | 1 | 2 | 3 | 4 | 5 |
|---|---|---|---|---|---|
| 1 | - | - | - | - | - |
| 2 | - | - | - | - | - |
| 3 | - | - | - | - | - |
| 4 | - | - | - | - | - |
| 5 | - | - | - | - | - |

Data signal

Scan signal

| | 1 | 2 | 3 | 4 | 5 |
|---|---|---|---|---|---|
| 1 | + | + | + | + | + |
| 2 | - | - | - | - | - |
| 3 | + | + | + | + | + |
| 4 | - | - | - | - | - |
| 5 | + | + | + | + | + |

Column Inversion

Data signal

Scan signal

| | 1 | 2 | 3 | 4 | 5 |
|---|---|---|---|---|---|
| 1 | - | - | - | - | - |
| 2 | + | + | + | + | + |
| 3 | - | - | - | - | - |
| 4 | + | + | + | + | + |
| 5 | - | - | - | - | - |

Data signal

Scan signal

| | 1 | 2 | 3 | 4 | 5 |
|---|---|---|---|---|---|
| 1 | + | - | + | - | + |
| 2 | + | - | + | - | + |
| 3 | + | - | + | - | + |
| 4 | + | - | + | - | + |
| 5 | + | - | + | - | + |

Line Inversion

Data signal

Scan signal

| | 1 | 2 | 3 | 4 | 5 |
|---|---|---|---|---|---|
| 1 | - | + | - | + | - |
| 2 | - | + | - | + | - |
| 3 | - | + | - | + | - |
| 4 | - | + | - | + | - |
| 5 | - | + | - | + | - |

Data signal

Scan signal

| | 1 | 2 | 3 | 4 | 5 |
|---|---|---|---|---|---|
| 1 | + | - | + | - | + |
| 2 | + | + | - | + | - |
| 3 | + | - | + | - | + |
| 4 | + | + | - | + | - |
| 5 | + | - | + | - | + |

Data signal

Scan signal

| | 1 | 2 | 3 | 4 | 5 |
|---|---|---|---|---|---|
| 1 | - | + | - | + | - |
| 2 | - | - | + | - | + |
| 3 | - | + | - | + | - |
| 4 | - | - | + | - | + |
| 5 | - | + | - | + | - |

Dot Inversion

FIG. 1a (PRIOR ART)

METHOD AND CIRCUIT FOR LCD PANEL FLICKER REDUCTION

BACKGROUND OF THE INVENTION

1. Field of the Invention

This invention relates to a method and circuit for liquid crystal display (LCD) panel flicker reduction, particularly to an adjustment circuit to be added to an LCD panel, thus reducing LCD panel flicker.

2. Description of the Related Art

In recent years, LCDs are increasingly popular due to smaller space requirement and lower power consumption. Large-size and high resolution LCDs are replacing conventional displays such as cathode ray tube (CRT) displays. However, such LCDs generally have flicker on the panels, which becomes more severe when the size of the LCD increases.

An LCD generally uses AC driving because electrical breakdown is caused by long-term bias voltage being applied. The AC driving means that data is changed between positive and negative regions. A diagram of inversion driving types of a typical LCD is shown in FIG. 1*a*. In FIG. 1*a*, symbol "+" is positive driving and symbol "−" is negative driving. AC driving of an LCD can be divided into frame inversion, row inversion, column inversion and dot inversion. Additionally, scan signal potential has two types. For example, the tri-state of scan line potential is high potential $V_{high}$, low potential $V_{low}$ and compensation potential $V_{gc}$, where $V_{high}>V_{low}>V_{gc}$.

A schematic diagram of a typical LCD1 is shown in FIG. 1*b*. In FIG. 1*b*, the LCD includes a gate driver 10, a data driver 22 and an LCD panel. The LCD panel includes interlaced data lines and scan lines, which control display units. If one terminal of a display unit is connected to a common voltage source with common voltage level $V_{com}$, such a structure is referred as a capacitance coupling on common (Cs on Common) structure. If the one terminal of the display unit is connected to another scan line providing the voltage level, such a structure is referred as a capacitance coupling on gate (Cs on Gate) structure. LCD 1 as show in FIG. 1*b* has the Cs on Gate structure. For example, the data line 18*a* and the scan line 20*b* control a display unit or unit 13, which includes a transistor 12*ba*, a capacitor 14*ba* and a liquid crystal unit 16*ba*. Gate and drain of the transistor 12*ba* are respectively connected to the scan line 20*b* and the data line 18*a* to control transistor 12*ba* on/off by means of scan signal on the scan line 20*b* in order to write data signal on the data line 18*a* in the devices 14*ba* and 16*ba* of the unit 13. Data signal is stored in capacitor in voltage level to drive the liquid crystal unit 16*ba*. Another terminal of the capacitor 14*ba* is connected to the scan line 20*a*. When the scan line 20*b* is enabled, the scan line 20*a* thus presents a voltage level. The scan driver 10 sequentially outputs scan signals on the scan lines 20*a*, 20*b*, . . . , 20*m*, such that transistors in a row of display units are instantly turned on and transistors in other rows are turned off. When the transistors are turned on, the data driver 22 outputs corresponding data signals to the row of display units through the data lines 18*a*, 18*b*, . . . , 18*n* according to image data to be displayed. Accordingly, repeating the above scan and output operations can complete the desired image display. However, every scan line is a wire with impedance and connects a plurality of capacitors through a plurality of transistors.

Therefore, as known to people skilled in the art, scan signal will be affected by RC effect so as to change the waveform. For example, a scan signal on scan line 20*b* turns transistor 12*ba* on/off using a normal wave but turns transistor 12*bn* on/off using a deformed wave due to the RC effect. Both normal and deformed waves can offer a similar function but may cause an error in the deformed waveform. For example, the on/off may result in capacitor 16*ba* experiencing a correct data signal but capacitor 16*bn* experiencing an incorrect data signal. Further, the correct and incorrect data signals cause brightness or chromatic difference on an LCD which causes perceived flicker for views due to positive and negative cycle changes. The flicker intensifies with larger LCDs at higher operating frequencies.

Consequently, there is a need to develop new method and devices for LCD panel flicker reduction.

SUMMARY OF THE INVENTION

The present invention relates to a method and circuit for liquid crystal display (LCD) panel flicker reduction of an LCD panel.

In one aspect, the invention relates to an adjustment circuit to reduce an LCD panel flicker, wherein the LCD panel has a plurality of scan lines and a plurality of data lines. In one embodiment, the adjustment circuit includes a variable resistor, and a plurality of impedance adjustment devices, each with impedance and having a control terminal to be coupled with a DC voltage source through the variable resistor, a power terminal to be coupled with a common voltage source, and a scan line terminal to be coupled with a scan line, wherein the impedance of each of the impedance adjustment devices can be varied when the resistance of the variable resistor is varied. Each of the impedance adjustment devices in one embodiment has a transistor. The impedance of each of the impedance adjustment devices is much higher than the impedance of the corresponding scan line. And the common voltage source provides a common voltage signal with a voltage level in a range of between a high and a low voltage levels.

In another aspect, the invention relates to an LCD panel. In one embodiment, the LCD panel includes a plurality of scan lines, each having a first terminal and a second terminal, a plurality of data lines that interlaced to the plurality of scan lines, a plurality of display units disposed in each interlaced scan line and data line, a data driver connected to the data lines, a gate driver connected to first terminals of the scan lines, a variable resistor, and a plurality of impedance adjustment devices. Each of the impedance adjustment devices has a scan line terminal to be connected to a second terminal of a corresponding scan line, a control terminal to be coupled with a DC voltage source through the variable resistor and a power terminal to be coupled with a common voltage source, wherein the impedance of each impedance adjustment device can be varied when the resistance of the variable resistor is varied. Each of the impedance adjustment devices in one embodiment has a transistor. The impedance of each of the impedance adjustment devices is much higher than the impedance of the corresponding scan line. And the common voltage source provides a common voltage signal with a voltage level in a range of between a high and a low voltage levels.

In yet another aspect, the invention relates to a method for LCD panel flicker reduction of an LCD panel. In one embodiment, the LCD panel has a plurality of scan lines, each having a first terminal and a second terminal, a plurality of data lines that interlaced to the plurality of scan lines, a plurality of display units disposed in each interlaced scan line and data line, a variable resistor, and a plurality of impedance adjustment devices, each having a scan line terminal to be connected to a second terminal of a corresponding scan line, a control terminal to be coupled with a DC voltage source through the variable resistor and a power terminal to be coupled with a common voltage source. The method includes the step of changing resistance of the variable resistor to vary impedance of at least one impedance adjustment device to reduce the panel flicker. Each of the impedance adjustment devices in one embodiment has a transistor. The impedance of each of the impedance adjustment devices is much higher than the impedance of the corresponding scan line. And the common voltage source provides a common voltage signal with a voltage level in a range of between a high and a low voltage levels.

These and other aspects of the present invention will become apparent from the following description of the preferred embodiment taken in conjunction with the following drawings, although variations and modifications therein may be affected without departing from the spirit and scope of the novel concepts of the disclosure.

DESCRIPTION OF THE DRAWINGS

FIG. 1*a* is a diagram of inversion driving types of a typical LCD.

DETAILED DESCRIPTION OF THE INVENTION

Figure 1B:
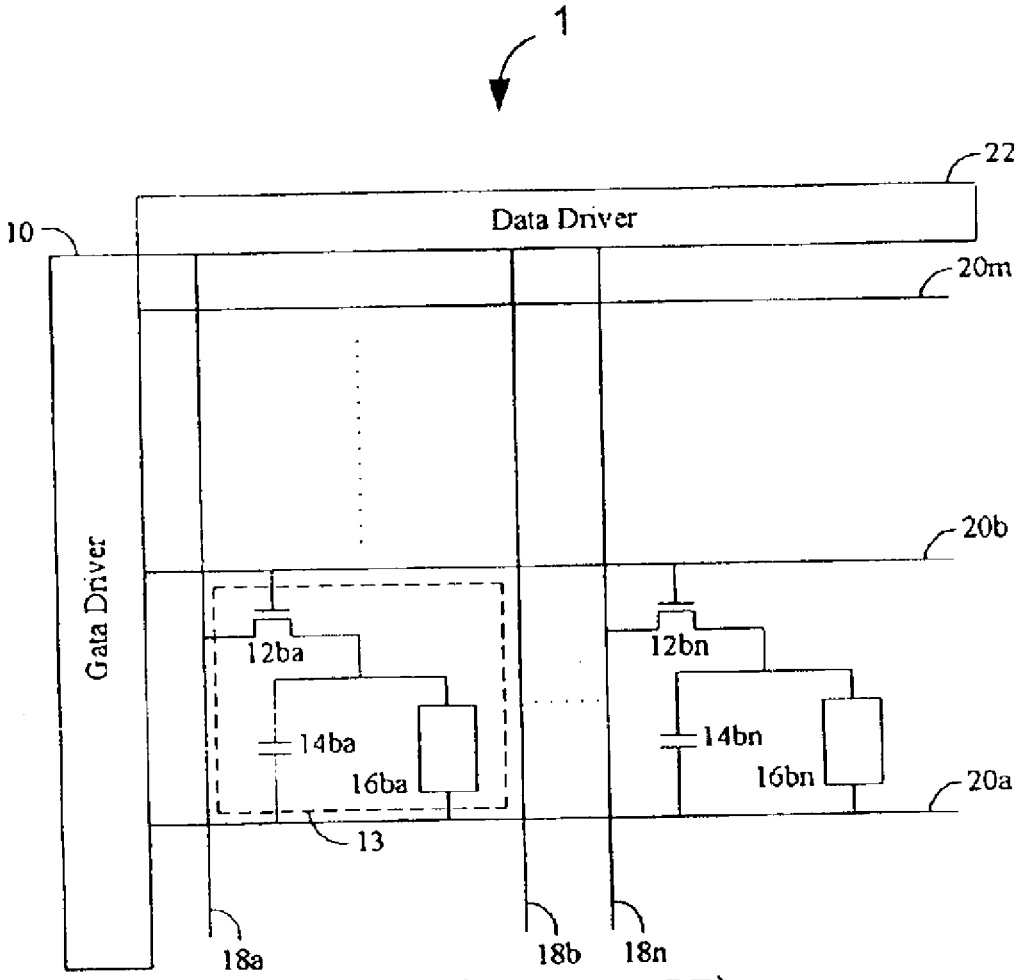
FIG. 1b (PRIOR ART)
FIG. 1*b* is a schematic block diagram of a typical LCD.
Figure 2:
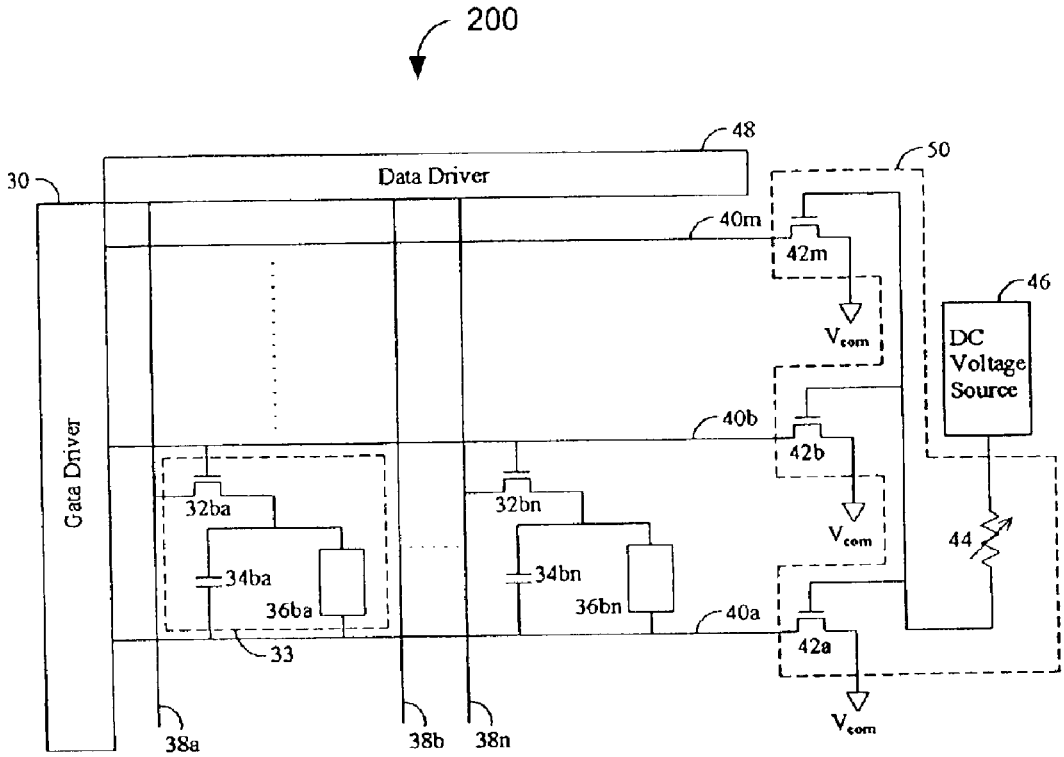
FIG. 2 is a schematic block diagram of an LCD according to one embodiment of the invention.

Referring now to FIG. 2, a schematic block diagram of an LCD 200 according to one embodiment of the invention is shown. In FIG. 2, the LCD 200 includes a gate driver 30, a data driver 48, interlaced data lines 38*a* to 38*n* and scan lines 40*a* to 40*m*, display units 33 and an adjustment circuit 50. As shown in FIG. 2, the gate driver 30 selects one of the scan lines and the data driver 48 selects one of the data lines in order to assign one of the display units to be operated. Moreover, all terminals not connected to the gate driver 30 of the scan lines are connected to the circuit 50. A display unit 33 is selected through data line 38*a* and scan line 40*b*. The unit 33 includes a transistor 32*ba*, a capacitor 34*ba* and a liquid crystal unit 36*ba*. Gate and drain of the transistor 32*ba* are respectively connected to the scan line 40*b* and the data line 38*a* to control the transistor 32*ba* on/off by scan signal on the scan line 40*b* in order to write data signal on the data line 38*a* in the capacitor 34*ba* and the liquid crystal unit 36*ba* of the unit 33. Data signal is stored in the capacitor 34*ba* by means of voltage level to drive the unit 36*ba*. Another terminal of the capacitor 34*ba* is connected to the scan line 40*a*. When the scan line 40*b* is enabled, the scan line 40*a* can provide a compensation voltage Vgc.

The adjustment circuit 50 has a variable resistor 44 and a plurality of impedance adjustment devices 42*a* to 42*m*. The devices 42*a* to 42*m* each includes a transistor. Control terminals, scan line terminals and power terminals of the devices 42*a* to 42*m* are respectively connected to the variable resistor 44, scan lines and the common voltage source with common voltage $V_{com}$. A DC voltage source 46 provides a DC voltage through the resistor 44 to supply a driving voltage to drive the devices 42*a* to 42*m*, and the impedance of each of the devices 42*a* to 42*m* is much higher than the impedance of each of the scan lines. The gate driver 30 sequentially outputs the scan lines 40*a*, 40*b*, . . . , 40*m* such that transistors in a row of display units are instantly turned on and transistors in other rows are turned off.

When the transistors are turned on, the data driver 22 outputs the corresponding data signals to the row of display units through data lines 38*a*, 38*b*, . . . , 38*n* according to image data to be displayed. At this point, because the impedances of the impedance adjustment devices 42*a* to 42*m* are much higher than the impedances of the scan lines 40*a* to 40*m*, respectively, the impedances of scan lines 40*a* to 40*m* can be neglected. Therefore, scan signal on the scan line 40*b* appropriately keeps the same waveform as an original input signal when driving the capacitors 34*ba* and 34*bn*, which is superior to the prior art LCD can offer. For example, according to the practical measurement, in one embodiment, the voltage difference between the data signals stored in the capacitors 34*ba* and 34*bn* and in the capacitors 14*ba* and 14*bn* were measured and compared, the former was 24.8 mV while the latter was 45 mV (due to data signal stored in a capacitor by means of voltage level) during positive driving, and the former was 45 mV while the latter was 160 mV during negative driving. Therefore, the LCD 200 according to one embodiment of the invention can provide much less brightness or chromatic difference than that of a prior art LCD panel such that the panel flicker is reduced.

Figure 3:
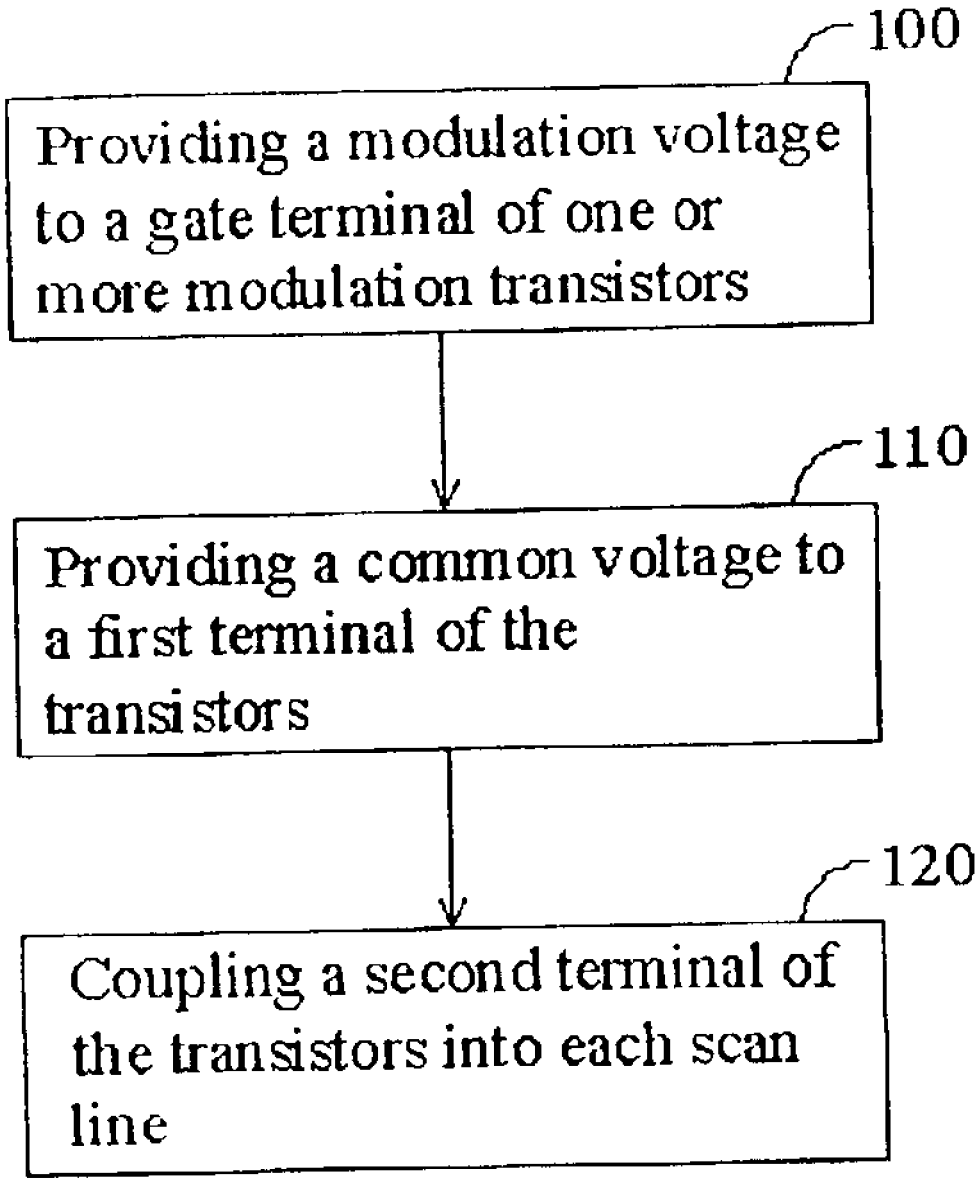
FIG. 3 is a flowchart schematically showing how to reduce the panel flicker in association with the LCD of FIG. 2 according to one embodiment of the invention.

Referring now to FIG. 3, a method for reducing the panel flicker in association with the LCD of FIG. 2 according to one embodiment of the invention is shown.

In step 100, a plurality of impedance adjustment devices 50 are coupled to first terminals of a plurality of scan lines of the LCD panel one-to-one, i.e., scan terminals of the devices 42*a* to 42*m* in the adjustment circuit 50 are coupled to the scan lines 40*a* to 40*m* one-to-one, correspondingly.

In step 110, control terminals of the impedance adjustment devices 50 are coupled to a DC voltage source 46 through a variable resistor, i.e., control terminals of the devices 42*a* to 42*m* in the adjustment circuit 50 are coupled to the variable resistor 44 connected to the DC voltage source 46.

In step 120, voltage terminals of the impedance adjustment devices 50 are coupled to a common voltage source, i.e., voltage terminals of the devices 42*a* to 42*m* in the adjustment circuit 50 are coupled to the common voltage source (not shown) with common voltage level $V_{com}$.

In operation, resistance of the variable resistor 44 is changed so as to vary impedance of every or at least one impedance adjustment device 50 to reduce panel flicker, i.e., the impedance of the variable resistor 44 is changed such that the impedances of the impedance adjustment devices are greatly higher than the impedances of the scan lines such that the impedances of scan lines can be neglected. Consequently, the RC effect associated with the prior art LCD panel is eliminated.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An adjustment circuit for reducing liquid crystal display (LCD) panel flicker for an LCD panel, wherein the LCD panel has a plurality of scan lines and a plurality of data lines, comprising:

a variable resistor; and a plurality of impedance adjustment devices, each with impedance and having:

a. a control terminal to be coupled with a DC voltage source through the variable resistor;

b. a power terminal to be coupled with a common voltage source; and c. a scan line terminal to be coupled with a scan line, wherein the impedance of each of the impedance adjustment devices is higher than the impedance of each of the scan lines and is varied when the resistance of the variable resistor is varied.

2. The adjustment circuit of claim 1, wherein each of the impedance adjustment devices comprises a transistor.

3. The adjustment circuit of claim 1, wherein the impedance of each of the impedance adjustment devices is much higher than the impedance of the corresponding scan line.

4. The adjustment circuit of claim 1, wherein the common voltage source provides a common voltage signal with a voltage level between a high and a low voltage levels.

5. An LCD panel, comprising:

a plurality of scan lines, each having a first terminal and a second terminal;

a plurality of data lines that interlaced to the plurality of scan lines;

a plurality of display units disposed in each interlaced scan line and data line;

a data driver connected to the data lines;

a gate driver connected to first terminals of the scan lines;

a variable resistor; and a plurality of impedance adjustment devices, each having a scan line terminal to be connected to a second terminal of a corresponding scan line, a control terminal to be coupled with a DC voltage source through the variable resistor and a power terminal to be coupled with a common voltage source, wherein the impedance of each impedance adjustment device is higher than the impedance of each of the scan lines and is varied when the resistance of the variable resistor is varied.

6. The LCD panel of claim 5, wherein each of the impedance adjustment devices comprises a transistor.

7. The LCD panel of claim 5, wherein the impedance of each of the impedance adjustment devices is much higher than the impedance of the corresponding scan line.

8. The LCD panel of claim 5, wherein the common voltage source provides a common voltage signal with a voltage level between a high and a low voltage levels.

9. A method for LCD panel flicker reduction of an LCD panel, wherein the LCD panel has a plurality of scan lines, each having a first terminal and a second terminal, a plurality of data lines that interlaced to the plurality of scan lines, a plurality of display units disposed in each interlaced scan line and data line, a variable resistor, and a plurality of impedance adjustment devices, each having a scan line terminal to be connected to a second terminal of a corresponding scan line, a control terminal to be coupled with a DC voltage source through the variable resistor and a power terminal to be coupled with a common voltage source, comprising the step of:

changing resistance of the variable resistor to vary impedance of at least one impedance adjustment device, wherein each of the impedance adjustment devices is higher than the impedance of each of the scan lines to reduce the panel flicker.

10. The adjustment circuit of claim 9, wherein each of the impedance adjustment devices comprises a transistor.

11. The adjustment circuit of claim 9, wherein the impedance of each of the impedance adjustment devices is much higher than the impedance of the corresponding scan line.

12. The adjustment circuit of claim 9, wherein the common voltage source provides a common voltage signal with a voltage level between a high and a low voltage levels.

* * * * *